US006343692B1

(12) United States Patent
Park

(10) Patent No.: US 6,343,692 B1
(45) Date of Patent: Feb. 5, 2002

(54) GOLF CLUB SHAFT PROTECTOR

(76) Inventor: Douglas Keon Park, 62-10 Woodside Ave., Apt. 410, Woodside, NY (US) 11377

( * ) Notice: Subject to any disclaimer, the term of this patent is extended or adjusted under 35 U.S.C. 154(b) by 0 days.

(21) Appl. No.: 09/347,706

(22) Filed: Jul. 3, 1999

(51) Int. Cl.[7] ..... A63B 57/00

(52) U.S. Cl. ..... 206/315.2; 206/315.6; 211/70.2

(58) Field of Search ..... 206/315.2, 315.6; 211/70.2

(56) References Cited

U.S. PATENT DOCUMENTS 4,938,349 A 7/1990 Burns ..... 206/315.6
5,088,600 A * 2/1992 Kopp, Jr. ..... 206/315.6 X
5,275,278 A 1/1994 Henry et al. ..... 206/315.6
5,632,690 A 5/1997 McConville ..... 206/315.6 X
5,720,388 A 2/1998 King et al. ..... 206/315.2
5,988,378 A * 11/1999 Bell, Jr. ..... 206/315.2

* cited by examiner

*Primary Examiner*—Sue A. Weaver
(74) *Attorney, Agent, or Firm*—Michael I Kroll

(57) ABSTRACT

The present invention 10 discloses a device for protecting golf clubs 14 from being scratched due to the golf clubs 14 being inserted into a golf club protection tube 18 which are commercially available. The present invention 10 discloses a flanged 42 tubular insert for placement into the top neck of the golf club protection tube 18. The present invention 10 is padded with soft pile material 34 having a hole 38 therein for inserting the golf club shaft 20. Another embodiment is provided which has a Y-shaped upstanding member 44 mounted on the top edge of the present invention 10 within which is placed the golf club head 26.

7 Claims, 12 Drawing Sheets

TOP VIEW

SIDE VIEW

TOP VIEW

SIDE VIEW

GOLF CLUB SHAFT PROTECTOR

BACKGROUND OF THE INVENTION

1. Field of the Invention

Figure 1:
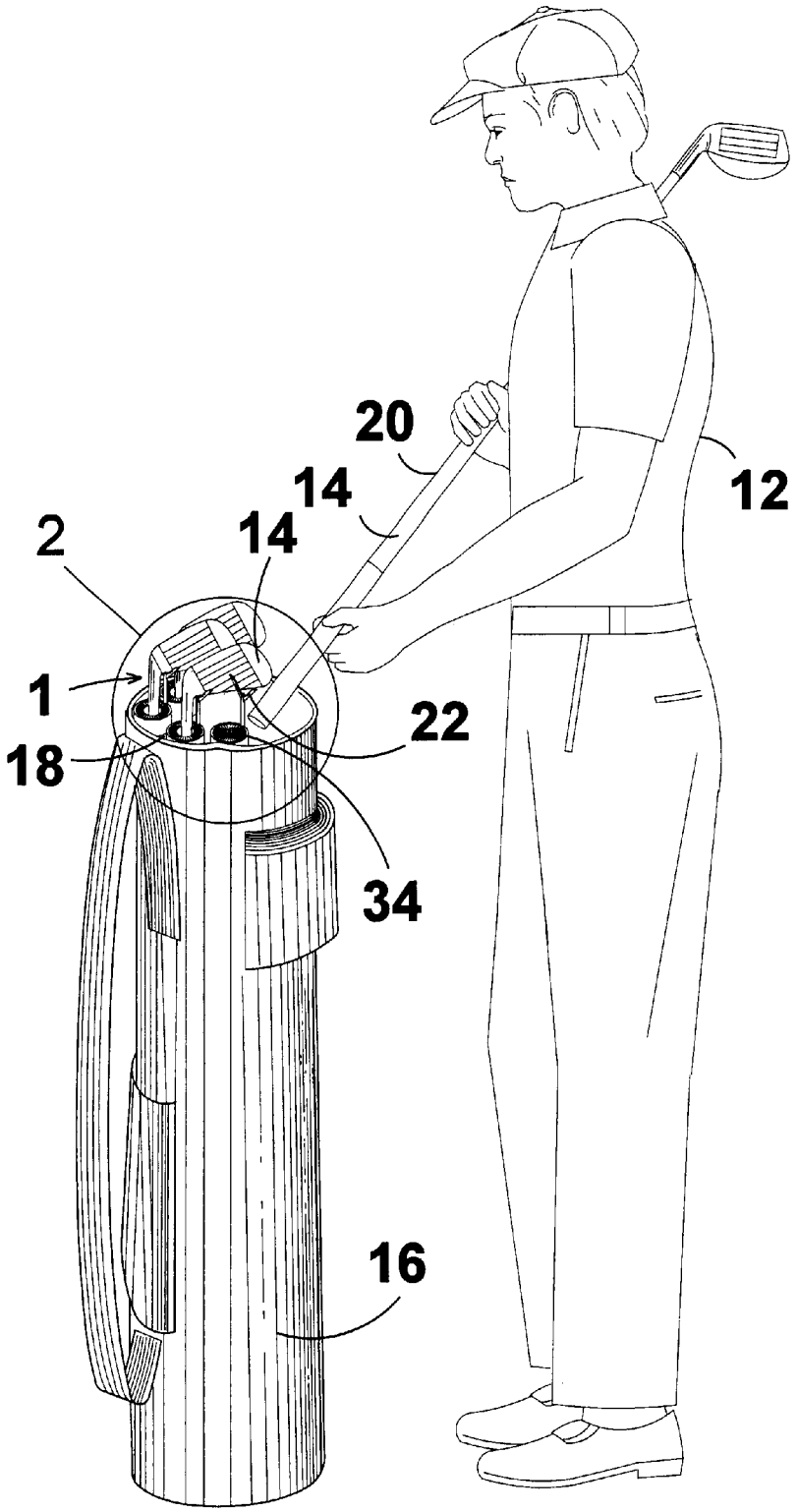

The present invention relates generally to golf equipment accessories and, more specifically, to a golf club protection device which can be inserted into the readily available individual golf club tubes which are sold and inserted into a golf bag to segregate and protect individual golf clubs. While these tubes do segregate the golf clubs one from the other they do not prevent the shafts from scraping the lip of the tube while being extracted from or inserted into during the course of play. This contact with the lip of the tube will remove the coating on graphite shafts.

The present invention comprising a flanged insert seats into the top opening of existing tubes by means of compression fitting or is therein permanently affixed by adhesive means and said flanged insert has an acrylic soft pile material circumferentially affixed to the interior wall of said flanged insert.

Another embodiment is provided having all of the properties of the preferred embodiment in addition to a club head bearing member comprised of a Y-shaped member fixedly attached to the exterior surface of the flanged insert therein providing means for supporting the club head within the V-portion and preventing any lateral movement of the club head which normally occurs during the course of play.

2. Description of the Prior Art

There are other golf club shaft protection devices. Typical of these is U.S. Pat. No. 4,938,349 issued to Burns on Jul. 3, 1990.

Another patent was issued to Henry et al. on Jan. 4, 1994 as U.S. Pat. No. 5,275,278. Yet another U.S. Pat. No. 5,632,690 was issued to McConville on May 27, 1997 and still yet another was issued on Feb. 24, 1998 to King et al. as U.S. Pat. No. 5,720,388.

U.S. Pat. No. 4,938,349

Inventor: Paul H. Burns

Issued: Jul. 3, 1990

A golf club protector for protecting the shaft of a club including a golf club housing tube having a protective interior and a protective collar provided at the upper end of the tube. Alternatively, an optional protective sleeve insertable within the tube having a protective collar attached thereto may be removably provided as a unit for a conventional tube. Where the housing tube includes a fixed collar and protective interior, the length of the tube may be predetermined in accordance with the length of a particular club shaft, or the tube may be provided with spaced apart cut markings at its lower end to facilitate shortening of the tube by the consumer.

U.S. Pat. No. 5,275,278

Inventor: Christopher J. Henry

Issued: Jan. 4, 1994

A golf club shaft protector is disclosed as including a hollow plastic tube of predetermined diameter and length with open upper and lower ends. The length of the hollow plastic tube substantially corresponds to the length of a golf club shaft and can be pre-selected and cut to the appropriate length. A flexible restricted throat element extends across the open upper end of the hollow plastic tube for resilient deformation upon the insertion of a golf club handle to allow passage of the golf club handle and associated golf club shaft into the hollow plastic tube. The flexible restricted throat element subsequently returns to its initial shape for close fitting circumferential support of the golf club hosel at an upper end of the golf club shaft adjacent the golf club head. The predetermined diameter of the hollow plastic tube is dimensioned to at least substantially peripherally engage the golf club handle at least adjacent the open lower end. The entire length of the golf club shaft is thus protected by the hollow plastic tube through the circumferential support of the golf club hosel by the flexible restricted throat opening at the open upper end and by the at least substantial peripheral engagement of the golf club handle at the lower open end so as to provide suspended non-engagement of the golf club shaft therebetween.

U.S. Pat. No. 5,632,690

Inventor: Dennis McConville

Issued: May 27, 1997

A wrap for protecting a portion of a golf club shaft from abrasion within a golf bag. The inventive device includes a pad strip for circumferentially extending about a shaft of a golf club. A securing strip extends from the pad strip for securing the pad strip in an annular configuration about the shaft to protect the shaft from abrasion against an upper interior surface of a receiving tube of a golf bag.

U.S. Pat. No. 5,720,388

Inventor: Jon E. King et al.

Issued: Feb. 24, 1998

A golf club shaft protector is disclosed as including an elongated hollow plastic tube having a polygonal cross-sectional configuration with an unequal number of sides interconnected to each other by corner sections. Each of the unequal number of sides have the same predetermined length and each of the corner sections have the same predetermined angular shape. One of each of the corner sections faces one of each of the sides. Preferably, the unequal number of sides is at least seven to provide the largest possible opening with the greatest amount of rigidity for receiving the golf club shaft, including a golf club handle. The golf club shaft protector also includes a tubular element mounted adjacent the open upper end of the hollow plastic tube and includes an outer wall section, an inner wall section and flexible lip sections. The outer wall section surrounds an outer wall area of the tube adjacent the open upper end, the inner wall section surrounds an inner wall area of the tube adjacent the open upper end and the flexible lip sections extend over the open upper end of the tube for resiliently supporting a golf club shaft in centered position relative to the hollow plastic tube. The aforementioned elements facilitate the entry and removal of a golf club shaft including a golf club handle or grip, while protecting the golf club shaft against marring, scratching or other damage while retained within the hollow plastic tube.

While these golf club shaft protection devices may be suitable for the purposes for which they were designed, they would not be as suitable for the purposes of the present invention, as hereinafter described.

SUMMARY OF THE PRESENT INVENTION

The present invention discloses a device for protecting golf clubs from being scratched due to the golf clubs being inserted into a golf club protection tube which are commercially available. The present invention discloses a flanged tubular insert for placement into the top neck of the golf club protection tube. The present invention is padded with soft pile material extending circumferentially about the insert having a hole therein for inserting of the golf club shaft. Another embodiment is provided which has a Y-shaped upstanding member mounted on the top edge of the present invention within which is placed the golf club head.

A primary object of the present invention is to provide a flanged insert which can be used in conjunction with existing golf club tubes for the protection of golf clubs.

Another object of the present invention is to provide a flanged insert which can be used in conjunction with existing golf club tubes to prevent the golf club shafts from contact with the lip of existing golf club tubes.

Yet another object of the present invention is to provide a golf club tube flanged insert having a lower portion of smaller diameter and an upper portion of greater diameter.

Still yet another object of the present invention is to provide a golf club tube flanged insert having a soft pile material circumferentially affixed to the greater upper interior wall of said flanged insert.

Yet another object of the present invention is to provide an alternate embodiment of a golf club tube flanged insert having a soft pile material circumferentially affixed to the greater upper interior wall of said flanged insert and further having a club head bearing member comprised of a Y-shaped member fixedly attached to the exterior surface of the flanged insert therein providing means for supporting the club head within the V-portion and preventing any lateral movement of the club head which normally occurs during the course of play.

Additional objects of the present invention will appear as the description proceeds.

The present invention overcomes the shortcomings of the prior art by providing a golf club protection device comprising a flanged insert which seats by compression fitting or adhesively fixed into the top opening of existing golf club protection tubes and said flanged insert having an acrylic soft pile material circumferentially affixed to the interior wall surface of said flanged insert.

Another embodiment is provided having all of the properties of the preferred embodiment in addition to a club head bearing member comprised of a Y-shaped member fixedly attached to the exterior surface of the flanged insert therein providing means for supporting the club head within the V-portion and preventing any lateral movement of the club head which normally occurs during the course of play.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

Figure 2:
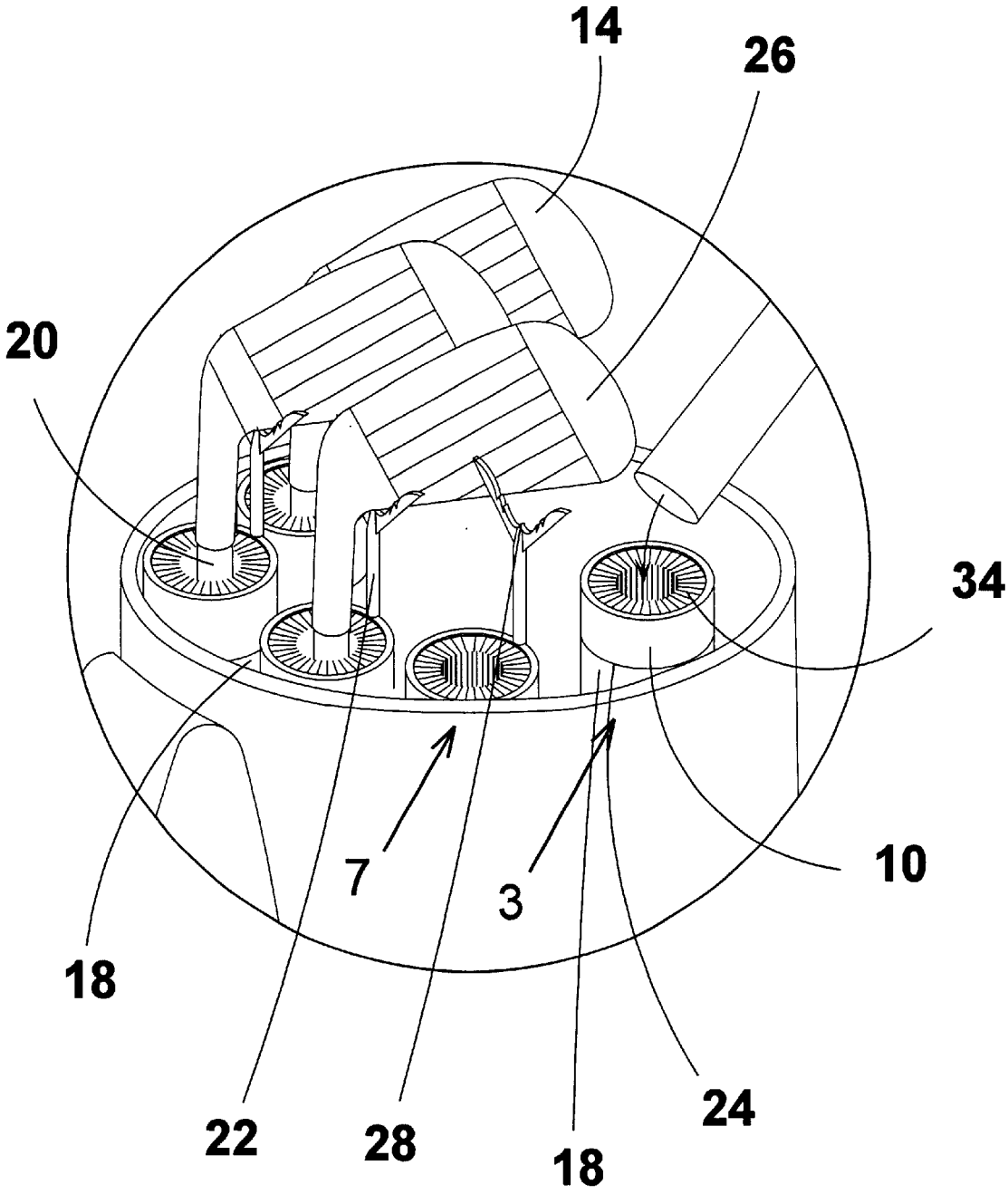
Figure 3:
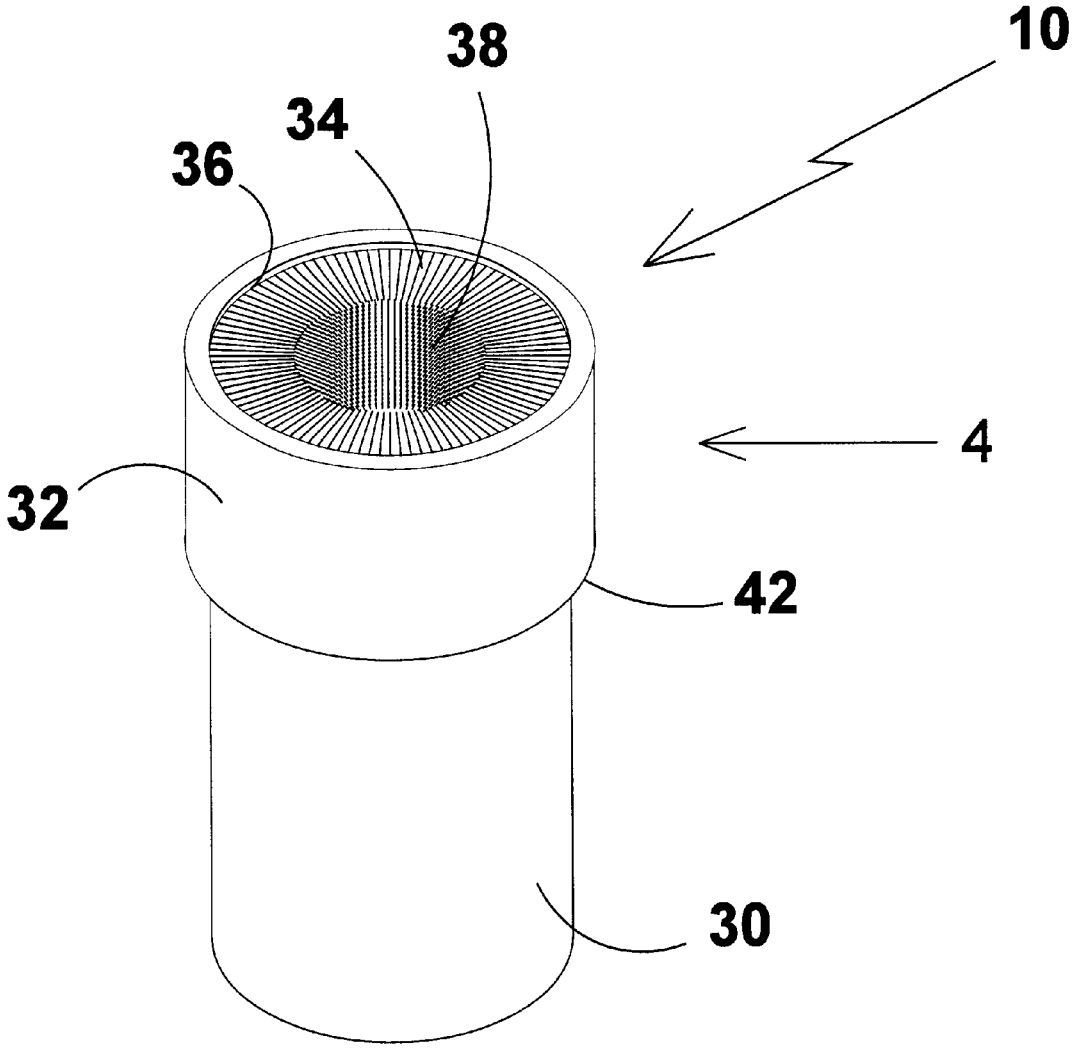
Figure 4:
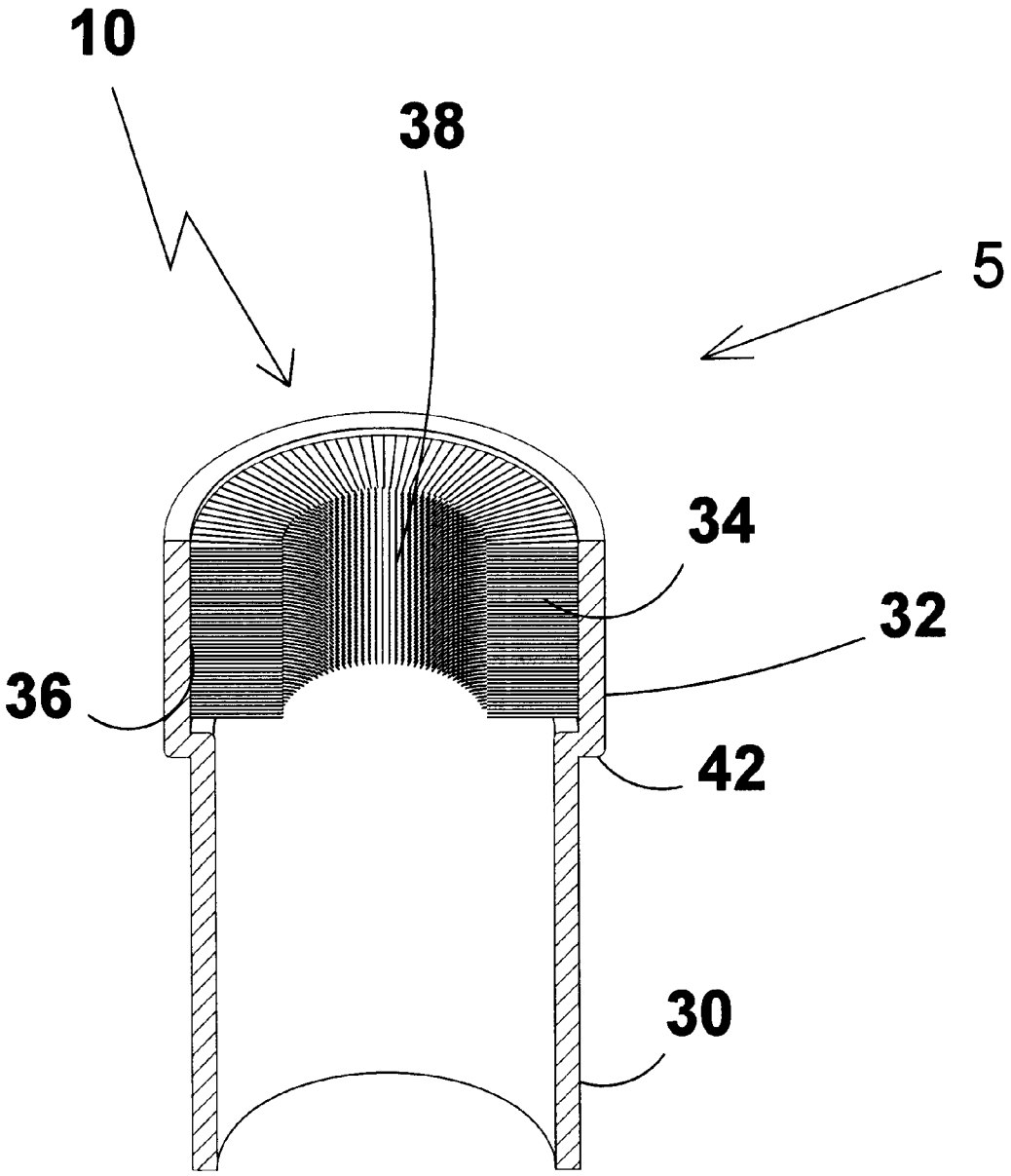
Figure 5:
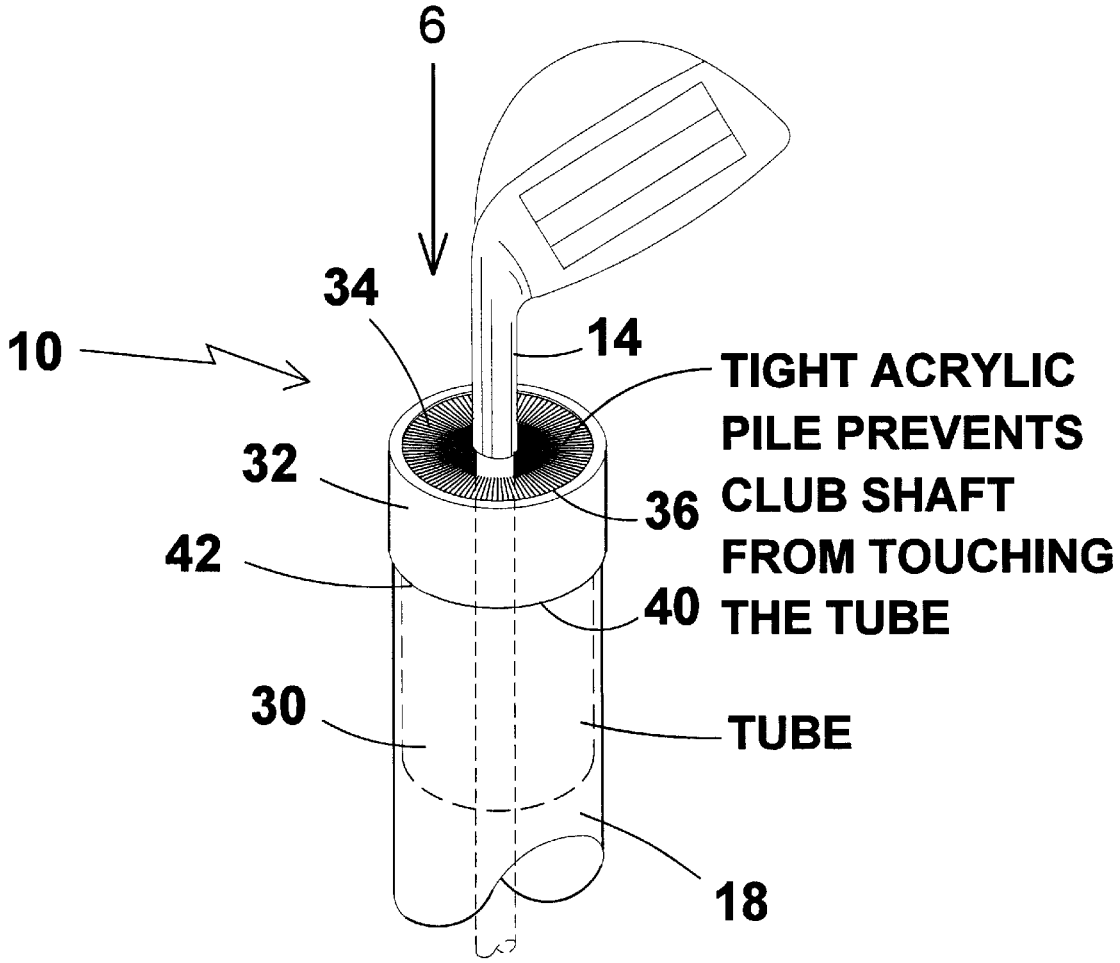
Figure 6:
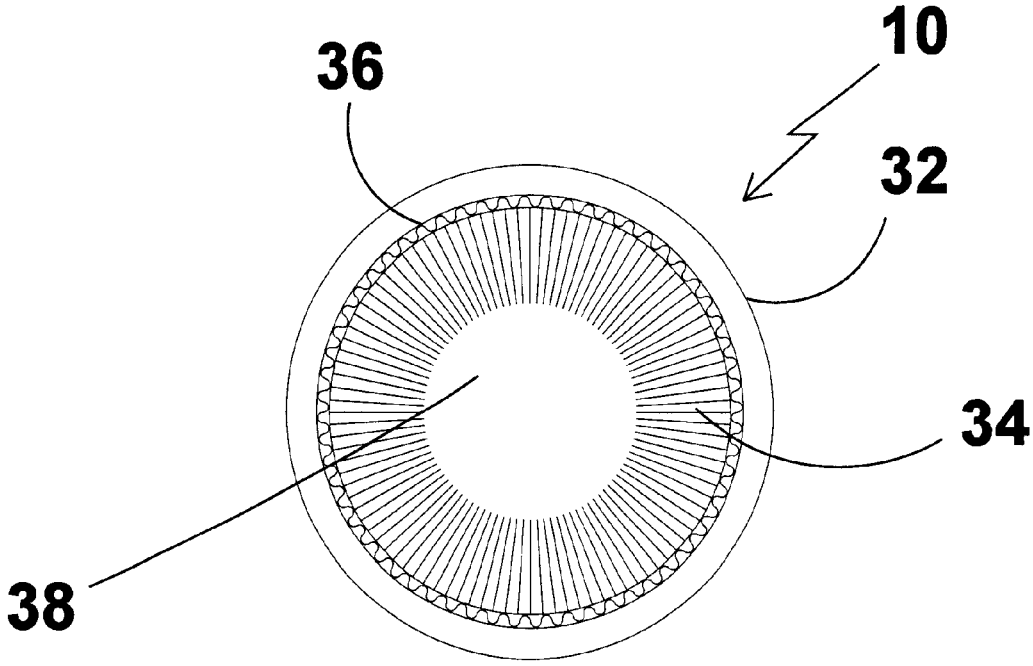
Figure 7:
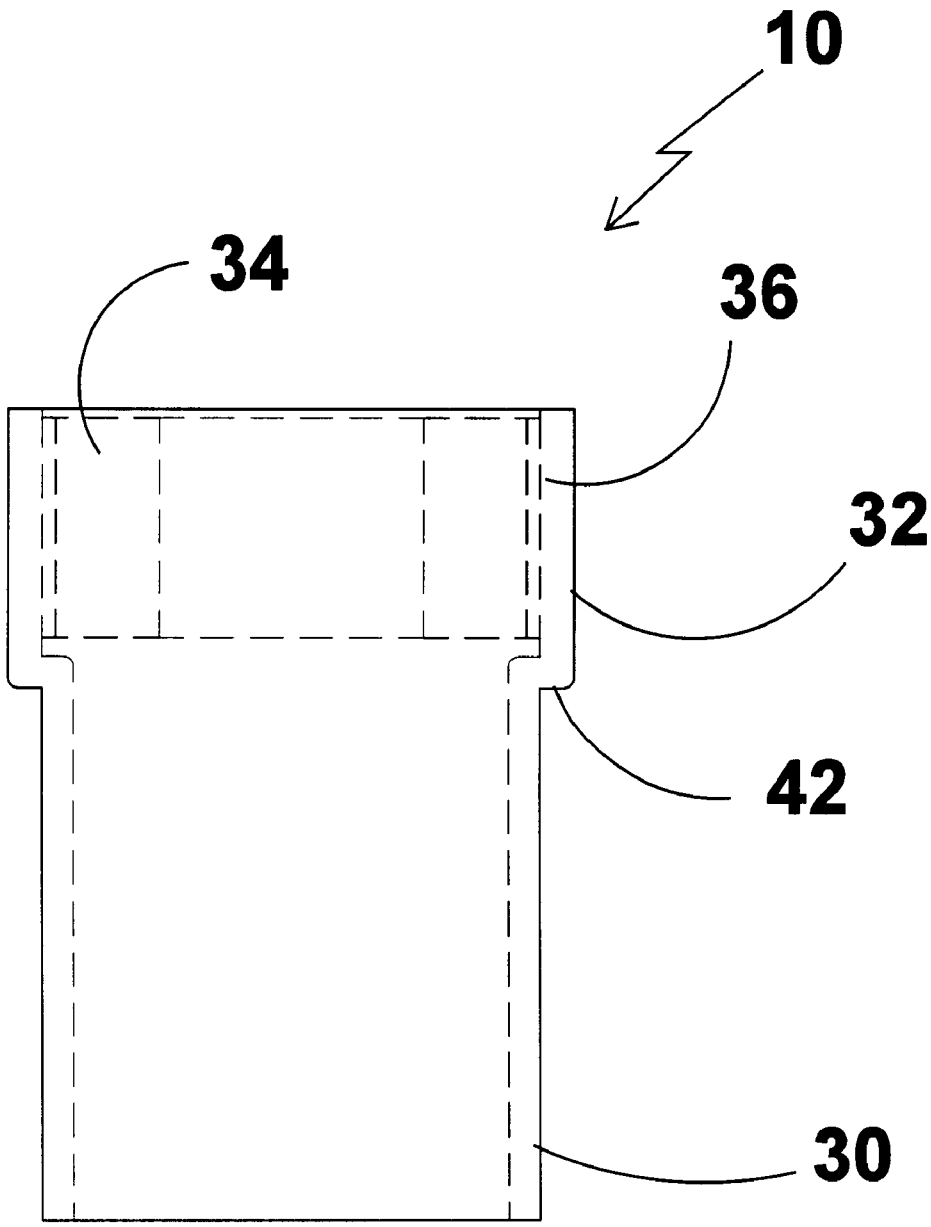
Figure 8:
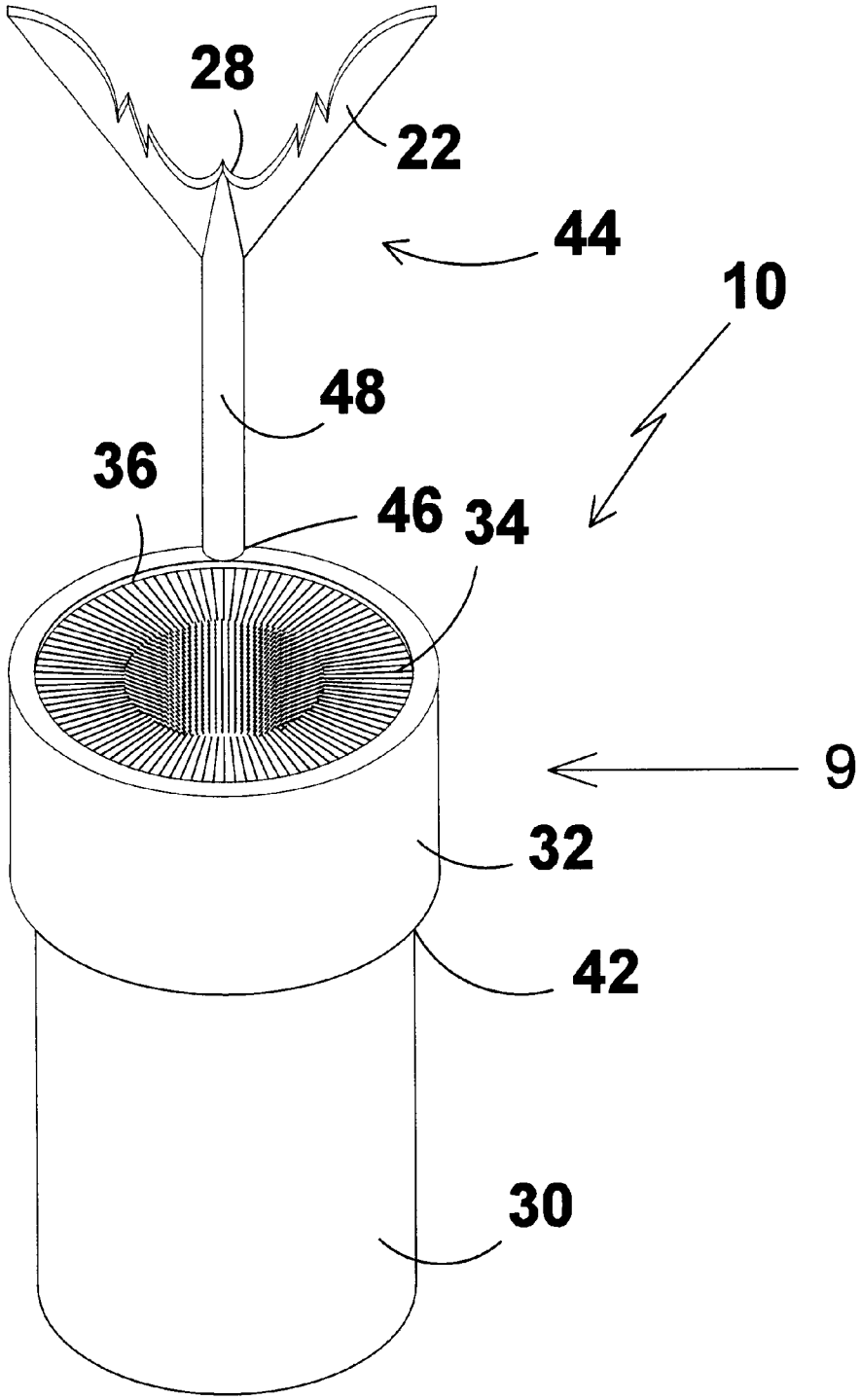
Figure 9:
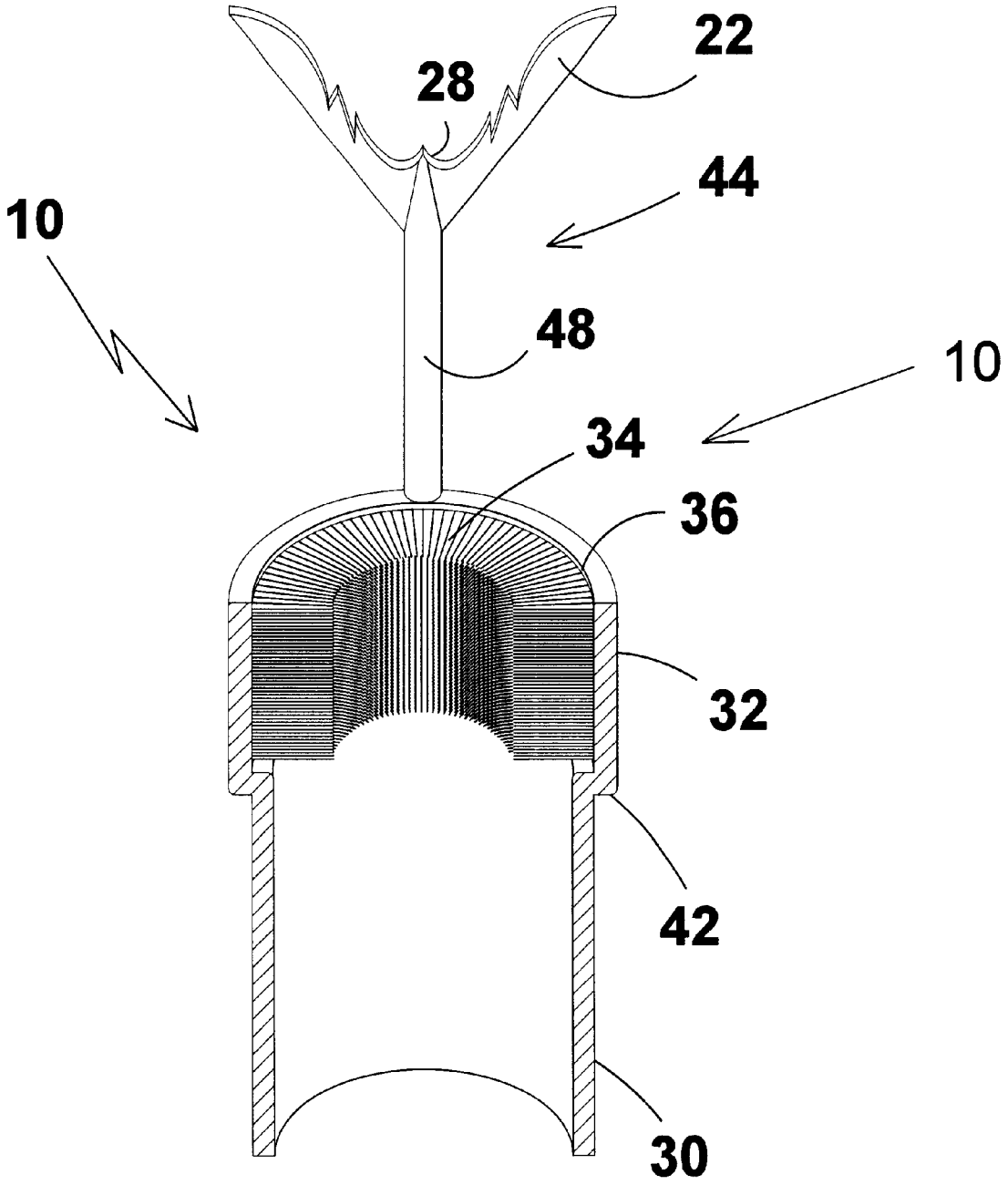
Figure 10:
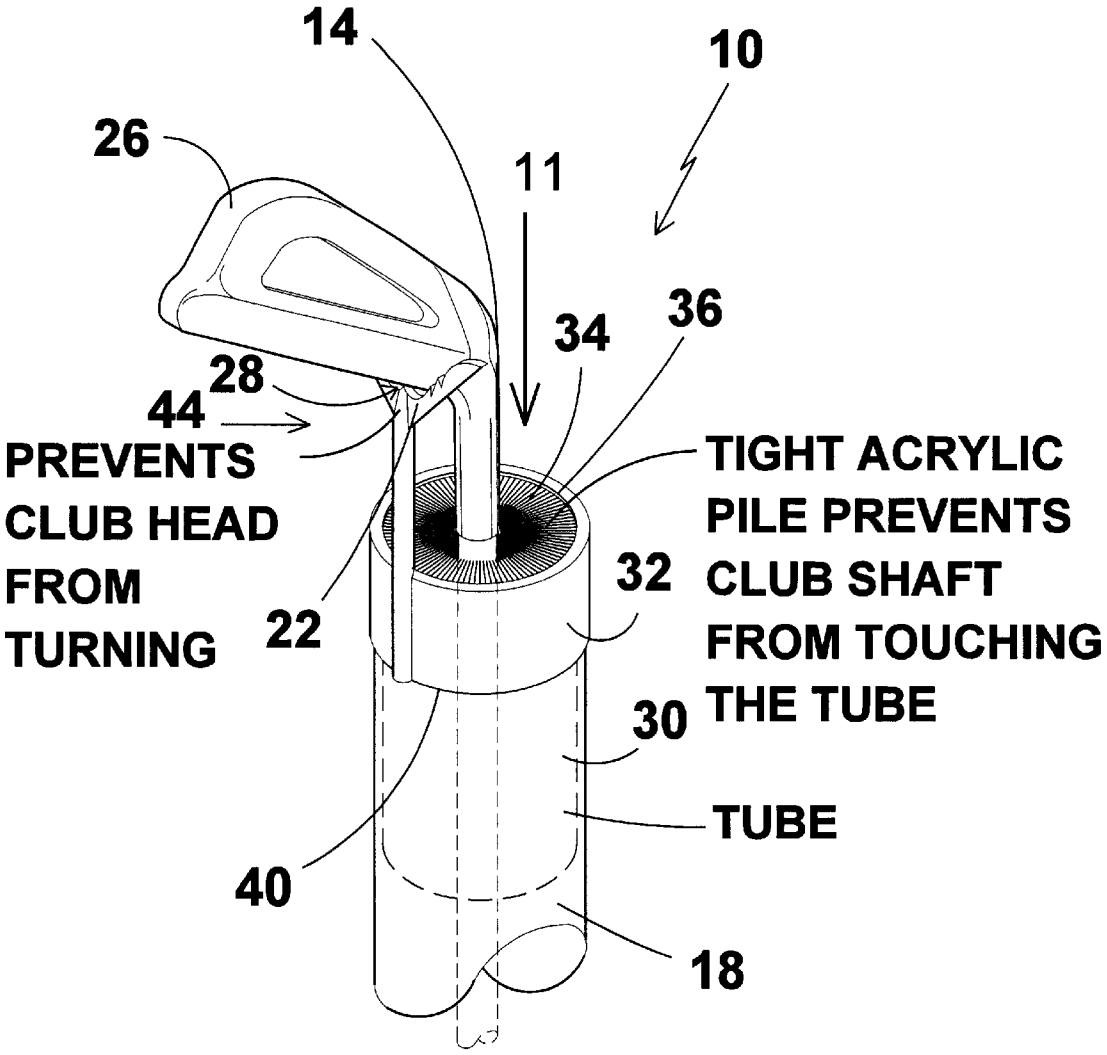
Figure 11:
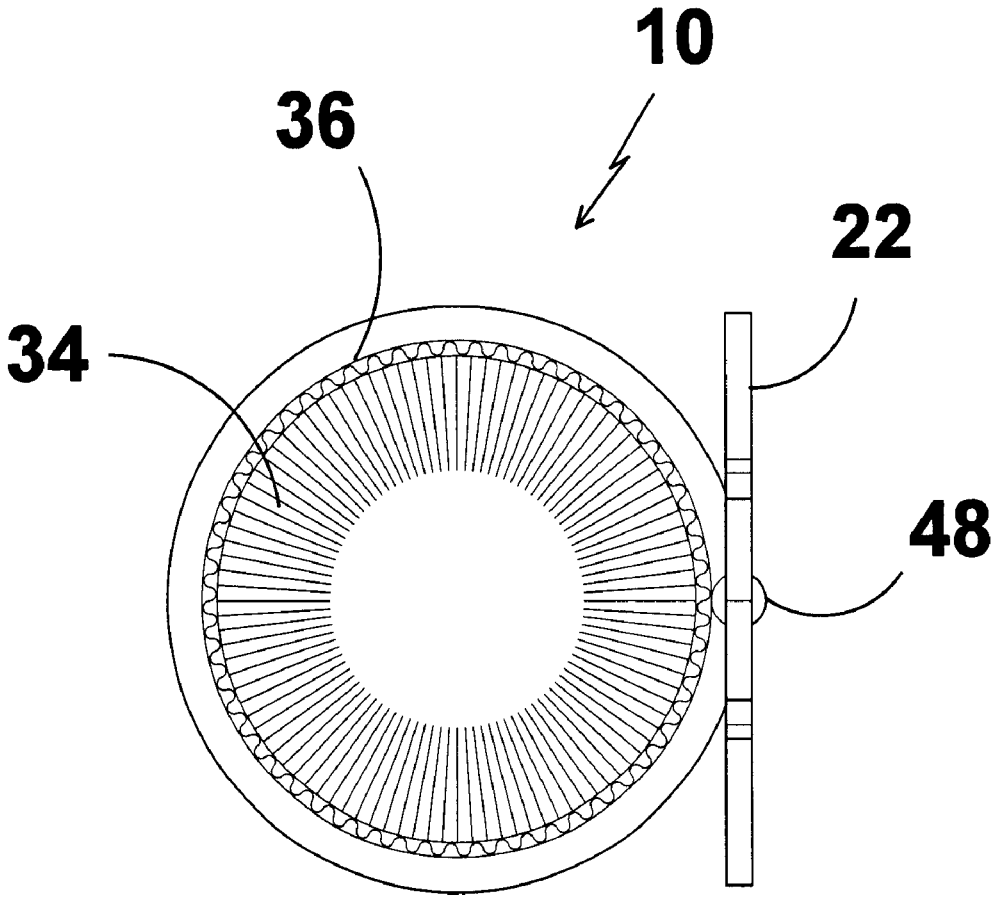
Figure 12:
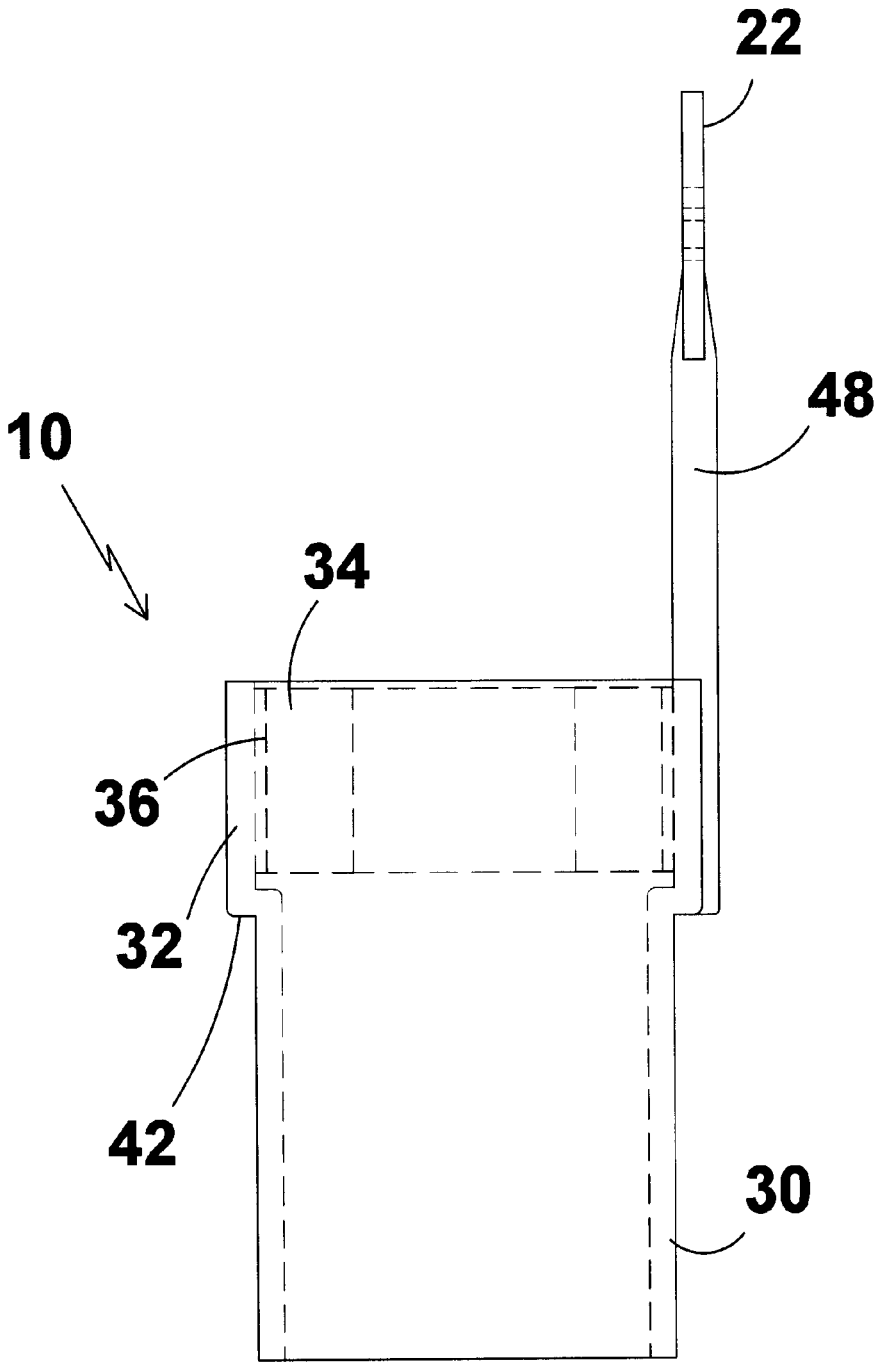

In order that the invention may be more fully understood, it will now be described, by way of example, with reference to the accompanying drawings in which:

FIG. 1 is a perspective view of the present invention in use. Shown is a golfer inserting a golf club into a golf bag having the present invention installed into individual golf club protection tube. The soft pile material located on the interior surface of the flanged insert will prevent the golf club shaft from contacting the rim of the golf club tube thereby preventing the coating from being abrasively removed through said contact. Also shown is another embodiment of the present invention having a Y-shaped golf head bearing member fixedly attached to the exterior of the flanged insert thereby preventing an lateral movement of the golf club during the course of play;

FIG. 2 is an enlarged view, taken from FIG. 1 as indicated, showing the present invention installed into typical golf club tubes. The flanged insert having a soft pile material fixedly attached to the interior surface will prevent the golf club shaft from contacting the lip of the golf club tube. Also shown are golf clubs having the head contained within the groove of a flanged insert having a Y-shaped club head bearing member;

FIG. 3 is a perspective view of the preferred embodiment of the present invention. Shown is a flanged cylindrical device having a lower portion of smaller diameter which is insert into an existing golf club tube and an upper greater diameter portion which extends above the rim of said golf club tube. Further shown is a soft pile material circumferentially fixed to the interior of the flanged cylindrical device;

FIG. 4 is a cross sectional view of the preferred embodiment of the present invention, taken from FIG. 3 as indicated. Shown is a flanged cylindrical device having a lower portion of smaller diameter which is insert into an existing golf club tube and an upper greater diameter portion which extends above the rim of said golf club tube. Further shown is a soft pile material circumferentially fixed to the interior of the upper greater diameter of the flanged cylindrical device;

FIG. 5 is an illustrative view of the preferred embodiment of the present invention in use. Shown is a golf club inserted into a flanged cylindrical device having a lower portion of smaller diameter which is insert into an existing golf club tube and an upper greater diameter portion which extends above the rim of said golf club tube. Further shown is a soft pile material circumferentially fixed to the interior of the flanged cylindrical device therein preventing said golf club from contacting said golf club tube;

FIG. 6 is a top plan view of the preferred embodiment of the present invention. Shown is a soft pile material circumferentially fixed to the interior of the flanged cylindrical device therein preventing a golf club from contacting the lip of a golf club tube;

FIG. 7 is a side view of the preferred embodiment of the present invention. Shown is a flanged cylindrical device having a lower portion of smaller diameter which is insert into an existing golf club tube and an upper greater diameter portion which extends above the rim of said golf club tube. Further shown, in outline, is a soft pile material circumferentially fixed to the interior of the flanged cylindrical device therein preventing said golf club from contacting said golf club tube;

FIG. 8 is a perspective view of the alternate embodiment of the present invention. Shown is a flanged cylindrical device having a lower portion of smaller diameter which is insert into an existing golf club tube and an upper greater diameter portion which extends above the rim of said golf club tube. Also shown is a soft pile material circumferentially fixed to the interior of the flanged cylindrical device. Further said device has a club head bearing member comprised of a Y-shaped member fixedly attached to the exterior surface of the flanged insert therein providing means for supporting the club head within the V-portion and preventing any lateral movement of the club head which normally occurs during the course of play;

FIG. 9 is a cross sectional view of the alternate embodiment of the present invention, taken from FIG. 8 as indicated. Shown is a flanged cylindrical device having a lower portion of smaller diameter which is insert into an existing golf club tube and an upper greater diameter portion which extends above the rim of said golf club tube. Further shown is a soft pile material circumferentially fixed to the interior of the upper greater diameter of the flanged cylindrical device and said device has a club head bearing member comprised of a Y-shaped member fixedly attached to the exterior surface of the flanged insert therein providing means for supporting the club head within the V-portion and preventing any lateral movement of the club head which normally occurs during the course of play;

FIG. 10 is an illustrative view of the alternate embodiment of the present invention in use. Shown is a golf club inserted into a flanged cylindrical device having a lower portion of smaller diameter which is insert into an existing golf club tube and an upper greater diameter portion which extends above the rim of said golf club tube. Further shown is a soft pile material circumferentially fixed to the interior of the flanged cylindrical device therein preventing said golf club from contacting said golf club tube. Further said device has a club head bearing member comprised of a Y-shaped member fixedly attached to the exterior surface of the flanged insert therein providing means for supporting the club head within the V-portion and preventing any lateral movement of the club head which normally occurs during the course of play;

FIG. 11 is a top plan view of the alternate embodiment of the present invention. Shown is a soft pile material circumferentially fixed to the interior of the flanged cylindrical device therein preventing a golf club from contacting the lip of a golf club tube;

FIG. 12 is a side view of the alternate embodiment of the present invention. Shown is a flanged cylindrical device having a lower portion of a smaller diameter which is insert into an existing golf club tube and an upper greater diameter portion which extends above the rim of said golf club tube. Further shown, in outline, is a soft pile material circumferentially fixed to the interior of the flanged cylindrical device therein preventing said golf club from contacting said golf club tube.

DESCRIPTION OF THE PREFERRED EMBODIMENT(S)

In order that the invention may be more fully understood, it will now be described, by way of example, with reference to the accompanying drawings in which FIGS. 1 through 12 illustrate the present invention being a golf club protection device.

Turning to FIG. 1, shown therein is a perspective view of the present invention 1 in use. Shown is a golfer 12 inserting a golf club 14 into a golf bag 16 having the present invention 1 installed into individual golf club protection tubes 18. The soft pile material 34 located on the interior surface of the flanged insert will prevent the golf club shaft 20 from contacting the rim of the golf club tube thereby preventing the coating from being abrasively removed through such contact. Also shown is another embodiment of the present invention having a Y-shaped golf head bearing member 22 fixedly attached to the exterior of the flanged insert thereby preventing lateral movement of the golf club 14 during the course of play.

Turning to FIG. 2, shown therein is an enlarged view, taken from FIG. 1 as indicated, showing the present invention 10 installed into typical golf club tubes 18. The flanged insert is a cylindrically shaped tube open on both ends and has a soft pile material 34 fixedly attached to the interior surface which will prevent the golf club shaft 20 from contacting the lip 24 of the golf club tube 18. Also shown are golf clubs 14 having the head 26 contained within the groove 28 of a flanged insert having a Y-shaped club head bearing member 22.

Turning to FIG. 3, shown therein is a perspective view of the preferred embodiment of the present invention 10. Shown is a flanged 42 cylindrical device 10 having a lower portion 30 of smaller diameter which is inserted into an existing golf club tube (not shown) and an upper greater diameter portion 32 which extends above the rim of said golf club tube. Also shown is a soft pile material 34 circumferentially fixed to the interior 36 of the flanged cylindrical device 10 having a hole 38 exposed in its center for insertion of the golf club (not shown).

Turning to FIG. 4, shown therein is a cross sectional view of the preferred embodiment of the present invention 10, taken from FIG. 3 as indicated. Shown is a flanged 42 cylindrical device 10 having a lower portion 30 of smaller diameter which is inserted snugly into an existing golf club tube (not shown) and an upper greater diameter portion 32 which extends above the rim of the golf club tube. Also shown is a soft pile material 34 circumferentially fixed to the interior 36 of the upper greater diameter portion of the flanged cylindrical device having a hole 38 in its center the hole 38 being parallel to the longitudinal axis of the insert 10.

Turning to FIG. 5, shown therein is an illustrative view of the preferred embodiment of the present invention 1 in use. Shown is a golf club 14 inserted into a flanged 42 cylindrical device 10 having a lower portion 30 of smaller diameter which is inserted into an existing golf club tube 18 and an upper greater diameter portion 32 which protrudes or extends above the top rim 40 of said golf club tube 18. Flange 42 rests on rim 40. Also shown is a soft pile material 34 circumferentially fixed to the interior 36 of the flanged cylindrical device 10 thereby preventing the golf club 14 from contacting the golf club tube 18.

Turning to FIG. 6, shown therein is a top plan view of the preferred embodiment of the present invention 1. Shown is a soft pile material 34 circumferentially fixed to the interior 36 of the flanged cylindrical device 10 thereby preventing a golf club (not shown) from contacting the lip of a golf club tube. Hole 38 is also shown, along with upper, large diameter portion 32 of the present invention 10.

Turning to FIG. 7, shown therein is a side view of the preferred embodiment of the present invention 1. Shown is a flanged 42 cylindrical device 10 having a lower portion 30 of a smaller diameter which is inserted into an existing golf club tube (not shown) and an upper greater diameter portion 32 which extends above the rim of the golf club tube (not shown). Further shown, in outline, is a soft pile material 34 circumferentially fixed to the interior 36 of the flanged cylindrical device 10 thereby preventing said golf club (not shown) from contacting said golf club tube (not shown).

Turning to FIG. 8, shown therein is a perspective view of the alternate embodiment of the present invention 1. Shown is a flanged 42 cylindrical device 10 having a lower portion 30 of smaller diameter which is inserted into an existing golf club tube (not shown) and an upper greater diameter portion 32 which extends above the rim of the golf club tube. Also shown is a soft pile material 34 circumferentially fixed to the interior 36 of the flanged cylindrical device. The device has a club head bearing member 44 comprised of a Y-shaped member 22 fixedly attached by means 46 to the top edge of the upper portion of the flanged insert thereby providing means for supporting the club head within the V-portion 28 bottom and preventing any lateral movement of the club head which normally occurs during the course of play. The Y-shaped member has a grooved area 28 formed at the bottom of the V along with an upright standing elongated rod-like support member 48 attached to tube 10.

Turning to FIG. 9, shown therein is a cross sectional view of the alternate embodiment of the present invention 1, taken from FIG. 8 as indicated. Shown is a flanged 42 cylindrical device having a lower portion 30 of smaller diameter which is inserted into an existing golf club tube (not shown) and an upper 32 greater diameter portion which extends above the rim of the golf club tube. Also shown is a soft pile material 34 circumferentially fixed to the interior 36 of the upper greater diameter portion 32 of the flanged cylindrical device and the device has a club head bearing member 44 comprised of a Y-shaped member 22 fixedly attached to the exterior surface of the flanged insert 10 thereby providing means for supporting the club head within the V-portion bottom 28 and preventing any lateral movement of the club head which normally occurs during the course of play.

Turning to FIG. 10, shown therein is an illustrative view of the alternate embodiment of the present invention 1 in use. Shown is a golf club 14 inserted into a flanged cylindrical device having a lower portion 30 of smaller diameter which is inserted into an existing golf club tube 18 and an upper greater diameter portion 32 which extends above the rim 40 of the golf club tube 18. Also shown is a soft pile material 34 circumferentially fixed to the interior 36 of the flanged cylindrical device therein preventing the golf club 14 from contacting the golf club tube 18. The device 10 has a club head bearing member 44 comprised of a Y-shaped member 22 fixedly attached to the exterior surface of the flanged insert therein providing means for supporting the club head 26 within the V-portion 28 and preventing any lateral movement of the club head 26 which normally occurs during the course of play.

Turning to FIG. 11, shown therein is a top plan view of the alternate embodiment of the present invention 1. Shown is a soft pile material 34 circumferentially fixed to the interior 36 of the flanged cylindrical device therein preventing a golf club from contacting the lip of a golf club tube (not shown). The Y-shaped member 22 is also shown along with support member 48 and upper larger diameter portion 32 of the insert 10.

Turning to FIG. 12, shown therein is a side view of the alternate embodiment of the present invention 1. Shown is a flanged 42 cylindrical device having a lower portion 30 of smaller diameter which is inserted into an existing golf club tube (not shown) and an upper greater diameter portion 32 which extends above the rim of the golf club tube. Also shown, in outline, is a soft pile material 34 circumferentially fixed to the interior 36 of the flanged cylindrical device thereby preventing a golf club from contacting the golf club tube. The Y-shaped member 22 is also shown along with support member 48.

LIST OF REFERENCE NUMERALS

With regard to reference numerals used, the following numbering is used throughout the drawings.

10 present invention
12 golfer
14 golf club
16 golf bag
18 tube
20 golf club shaft
22 Y-shaped member
24 lip of tube
26 head of golf club
28 bottom of Y-shaped member
30 lower portion
32 upper portion
34 soft pile material
36 interior of upper portion
38 hole
40 rim of tube
42 flange
44 club head bearing member
46 attachment means
48 support member

What is claimed to be new and desired to be protected by Letters Patent is set forth in the appended claims.

I claim:

1. An apparatus for protecting a golf club shaft from being scratched by a club protection tube, comprising:

a) a cylindrical shaped tube;

b) said tube being open on both ends for receiving a golf club shaft;

c) a smaller diameter portion of said tube for insertion in the golf club protection tube;

d) a larger diameter portion of said tube protruding above the top of the golf protection tube;

e) a flange formed by the joinder of said smaller diameter portion of said tube and said larger diameter portion of said tube;

f) said flange resting on the top of the golf club protection tube;

g) a golf club head bearing member mounted on said cylindrically shaped tube for securing a golf club head and comprising a Y-shaped member mounted on the larger diameter portion of said cylindrically shaped tube for securing a golf club head;

h) said Y-shaped member having a base support member, said base support member being an elongated rod-like member, said rod-like member forming the base of said Y-shaped member and having means for attachment to said larger diameter portion of said tube; and i) said means for attachment being a one-piece molded unitary construction of said rod-like member and said larger diameter portion of said tube.

2. The apparatus of claim 1, further comprising a padding material circumferentially disposed on the interior of said larger diameter portion of said tube.

3. The apparatus of claim 2, further comprising said padding material having a hole in its center, said hole being parallel to the longitudinal axis of said cylindrically shaped tube.

4. The apparatus of claim 3, wherein said padding material further comprises soft pile material.

5. The apparatus of claim 1, wherein said smaller diameter portion is sized to fit snugly into the golf club protection tube.

6. The apparatus of claim 1, wherein said smaller diameter portion has a diameter slightly less than the diameter of the golf club protection tube whereby said smaller diameter portion fits snugly into the golf club protection tube.

7. An apparatus for protecting a golf club shaft from being scratched by a club protection tube, comprising:

a) a cylindrical shaped tube;

b) said tube being open on both ends for receiving a golf club shaft;

c) a smaller diameter portion of said tube for insertion in the golf club protection tube;

d) a larger diameter portion of said tube protruding above the top of the golf protection tube;

e) a flange formed by the joinder of said smaller diameter portion of said tube and said larger diameter portion of said tube;

f) said flange resting on the top of the golf club protection tube;

g) a golf club head bearing member mounted on said cylindrically shaped tube for securing a golf club head and comprising a Y-shaped member mounted on the larger diameter portion of said cylindrically shaped tube for securing a golf club head;

h) said Y-shaped member having a base support member, said base support member being an elongated rod-like member, said rod-like member forming the base of said Y-shaped member, and said Y-shaped member being sized to receive a golf club head in the V-shaped part of said Y-shaped member.

* * * * *